US011091975B2

(12) United States Patent
Roselier et al.

(10) Patent No.: US 11,091,975 B2
(45) Date of Patent: Aug. 17, 2021

(54) EXPANDABLE METAL PACKER SYSTEM AND METHODOLOGY WITH ANNULUS PRESSURE COMPENSATION

(71) Applicant: SALTEL INDUSTRIES SAS, Bruz (FR)

(72) Inventors: Samuel Roselier, Bruz (FR); Romain Neveu, Bruz (FR); Jean-Louis Saltel, Le Rheu (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/495,414

(22) PCT Filed: Mar. 27, 2018

(86) PCT No.: PCT/EP2018/057730
§ 371 (c)(1),
(2) Date: Sep. 19, 2019

(87) PCT Pub. No.: WO2018/178053
PCT Pub. Date: Oct. 4, 2018

(65) Prior Publication Data

US 2020/0072018 A1 Mar. 5, 2020

(30) Foreign Application Priority Data

Mar. 27, 2017 (EP) ..... 17290044

(51) Int. Cl.
*E21B 33/127* (2006.01)
*E21B 33/12* (2006.01)
(Continued)

(52) U.S. Cl.
CPC ..... *E21B 33/1277* (2013.01); *E21B 33/1212* (2013.01); *E21B 34/101* (2013.01)

(58) Field of Classification Search
CPC .... E21B 33/127; E21B 33/1277; E21B 23/06; E21B 33/1212; E21B 34/101
See application file for complete search history.

(56) References Cited

U.S. PATENT DOCUMENTS 6,640,893 B1 * 11/2003 Rummel ..... E21B 33/1208 166/187
7,306,033 B2 * 12/2007 Gorrara ..... E21B 33/127 166/187

(Continued)

FOREIGN PATENT DOCUMENTS

EP 2206879 7/2010
WO WO2016/005292 1/2016

*Primary Examiner* — Catherine Loikith
(74) *Attorney, Agent, or Firm* — Michael Dae

(57) ABSTRACT

A technique facilitates use of a packer in a borehole or within other tubular structures. The packer may be constructed with a tubing, a metal sealing element mounted around the tubing, and a differential pressure valve system. The metal sealing element may be expanded under fluid pressure for sealing engagement with a surrounding wall surface. Additionally, the differential pressure valve system is placed in fluid communication with the interior of the metal sealing element and comprises a plurality of valves which operate automatically to increase pressure within the metal sealing element when certain pressure differentials occur. The differential pressure valve system enables the packer to hold against higher differential pressures and also may be constructed so the packer is less sensitive to thermal variations.

17 Claims, 6 Drawing Sheets

(51) Int. Cl.
*E21B 34/10* (2006.01)
*E21B 23/06* (2006.01)

(56) References Cited

U.S. PATENT DOCUMENTS

| | | | | |
|---|---|---|---|---|
| 7,591,321 | B2 | 9/2009 | Whitsitt et al. | |
| 9,217,308 | B2 * | 12/2015 | Wood | E21B 43/11 |
| 2006/0042801 | A1 | 3/2006 | Hackworth et al. | |
| 2016/0097254 | A1 | 4/2016 | Wood et al. | |
| 2016/0341003 | A1 | 11/2016 | Saltel et al. | |

* cited by examiner

EXPANDABLE METAL PACKER SYSTEM AND METHODOLOGY WITH ANNULUS PRESSURE COMPENSATION

BACKGROUND

The present document is based on and claims priority to EP Application Serial No.: 17290044.1, filed Mar. 27, 2017, which is incorporated herein by reference in its entirety.

In many well applications, packers are used to seal off sections of a wellbore. The packers are delivered downhole via a well string and then set against the surrounding wellbore surface to provide annular barriers between the adjacent uphole and downhole sections of wellbore. In various applications, each packer comprises an elastomeric element which may be expanded radially into sealing engagement with the surrounding borehole surface. Additionally, some applications utilize an expandable metal packer or packers. Such expandable metal packers use a deformable metal membrane which is deformed permanently by the pressure of inflating fluid. However, the seal between the deformable metal membrane and the surrounding wall surface may be susceptible to pressure differentials formed between sections of the annulus on uphole and downhole sides of the deformable metal membrane.

SUMMARY

In general, a system and methodology are provided for utilizing a packer in a borehole or within other tubular structures. The packer may be constructed with a tubing, a metal sealing element mounted around the tubing, and a differential pressure valve system. The metal sealing element may be expanded under fluid pressure for sealing engagement with a surrounding wall surface. Additionally, the differential pressure valve system is placed in fluid communication with the interior of the metal sealing element and comprises a plurality of valves which operate automatically to increase pressure within the metal sealing element when certain pressure differentials occur. The differential pressure valve system enables the packer to hold against higher differential pressures and also may be constructed so the packer is less sensitive to thermal variations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for utilizing a packer in a borehole or within other tubular structures. For example, one or more of the packers may be deployed downhole into a wellbore via a well string. The packer or packers may then be actuated to a set position to form a seal with the surrounding wellbore surface, e.g. an interior casing surface or an openhole surface, and to isolate sections of the annulus along the well string.

By way of example, the packer may be an expandable metal packer constructed with a metal sealing element and a differential pressure valve system. The metal sealing element may be mounted around a tubing which may be part of a well string or other tubing string. In some applications, the packer may comprise a section of tubing, e.g. mandrel, which forms part of the overall tubing string. When the packer is positioned at a desired location within the borehole or other tubular structure, the metal sealing element may be expanded under fluid pressure for sealing engagement with a surrounding wall surface. For example, the metal sealing element may be a permanently deformable metal bladder, e.g. membrane, which is deformed downhole via the fluid pressure, e.g. hydroforming. It should be noted "tubing" refers generally to tubular structures and includes various types of casing. For example, the tubing may comprise production casing, intermediate casing, surface casing, or other types of casing and the tubing string may be in the form of a casing string.

In this embodiment, the differential pressure valve system may be constructed to enable the expandable metal packer to hold against high differential pressures with little or no sensitivity to thermal variations. By way of example, the differential pressure valve system may comprise a plurality of valves in fluid communication with the interior of the metal sealing element. The plurality of valves operates automatically to increase pressure within the metal sealing element when certain pressure differentials occur. For example, the individual valves actuate automatically to different positions when relatively higher pressures occur in the annulus uphole or downhole from the metal sealing element to allow the relatively higher pressure access to an interior of the metal sealing element. Thus, the valves automatically compensate for the pressure differential. The valve system also may be constructed so the expandable metal packer is less sensitive to thermal variations.

Figure 1:
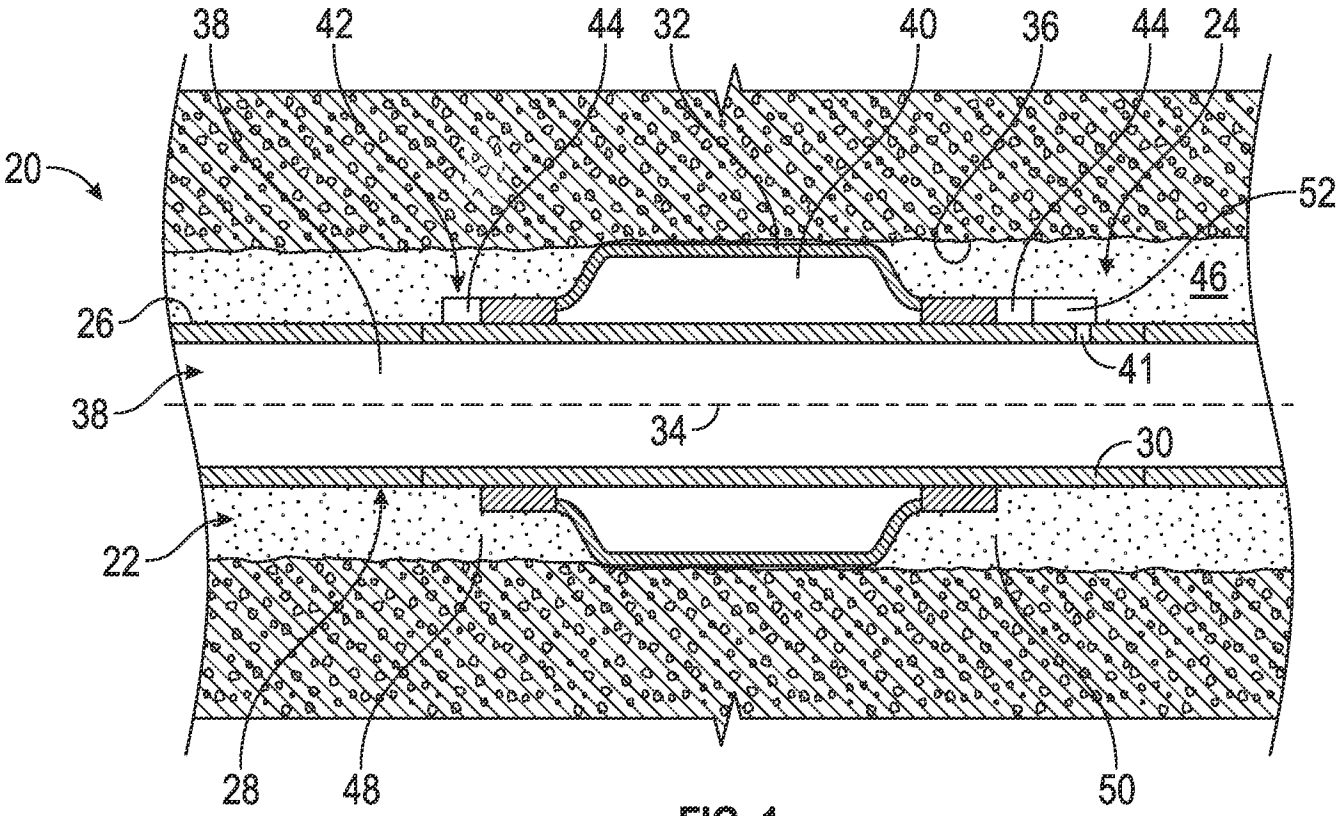
FIG. 1 is a cross-sectional illustration of an example of an expandable metal packer mounted along a tubing string in a borehole, according to an embodiment of the disclosure.

Referring generally to FIG. 1, an example of a well system 20 is illustrated as deployed in a borehole 22, e.g. a wellbore. The well system 20 comprises an expandable metal packer 24 mounted along a tubing 26 which may be part of an overall tubing string 28, e.g. a well production or casing string. In some embodiments, the expandable metal packer 24 may comprise an internal packer tubing 30, e.g. a packer mandrel, which may be part of the overall tubing 26. For example, the packer tubing/mandrel 30 may be constructed to facilitate incorporation of the expandable metal packer 24 into the overall tubing string 28.

In the embodiment illustrated, the expandable metal packer 24 comprises a metal sealing element 32. The metal sealing element 32 may be expanded radially outwardly in a direction away from a central axis 34 of tubing string 28. As illustrated, the metal sealing element 32 may be expanded outwardly until it engages a surrounding wall surface 36, e.g. a surrounding casing or open hole wellbore wall, in sealing engagement. By way of example, the metal sealing element 32 may comprise a metal membrane, e.g. bladder, or other metal structure which may be plastically deformed into a permanent expanded structure engaging surrounding wall surface 36. In some embodiments, the metal sealing element 32 is expanded via fluid pressure, e.g. via a hydroforming process. For example, high pressure fluid may be delivered along an interior 38 of tubing 26 and directed into an interior 40 of metal sealing element 32 via a passage or passages 41 extending through a wall of tubing 26 as illustrated.

According to the embodiment illustrated, the expandable metal packer 24 further comprises a valve system 42 which may be referred to as a differential pressure valve system. The valve system 42 comprises a plurality of valves 44 which may be automatically shifted in response to pressure differentials occurring on opposite axial sides of the metal sealing element 32 in an annulus 46 between tubing 26 and surrounding wall surface 36. For reference, the pressure differential results from a differential between a higher annulus pressure on one axial side of metal sealing element 32 (e.g. a first annulus section 48) and a relatively lower annulus pressure on the other axial side of metal sealing element 32 (e.g. a second annulus section 50) or vice versa.

In the example illustrated, at least one valve 44 is positioned on one axial side of metal sealing element 32 and at least one valve 44 is positioned on the opposite axial side of metal sealing element 32. The valves 44 are constructed and arranged to automatically shift in a manner which allows the relatively higher pressure on one side of the metal sealing element 32 access to the interior 40 of the metal sealing element 32. The higher pressure provides additional expansion pressure for biasing the metal sealing element 32 into a more secure sealing engagement with the surrounding wall surface 36. In this manner, the valve system 42 enables the expandable metal packer 24 to hold a sealed engagement with the surrounding wall surface 36 against higher pressure differentials. The valve system 42 also may be constructed to enable this annulus pressure compensation without detrimental sensitivity to thermal variations.

In some embodiments, the expandable metal packer 24 comprises an expansion valve 52 which is positioned to control flow of the pressurized fluid from the interior 38 of tubing 26 to the interior 40 of metal sealing element 32 during setting of packer 24. The expansion valve 52 may be positioned in fluid communication with the passage or passages 41 along, for example, an exterior of tubing 26. In some embodiments, the expansion valve 52 also may be operable to close off flow through the passage(s) 41 and to open a flow path between the annulus 46 and the interior 40 of metal sealing element 32.

Figure 2:
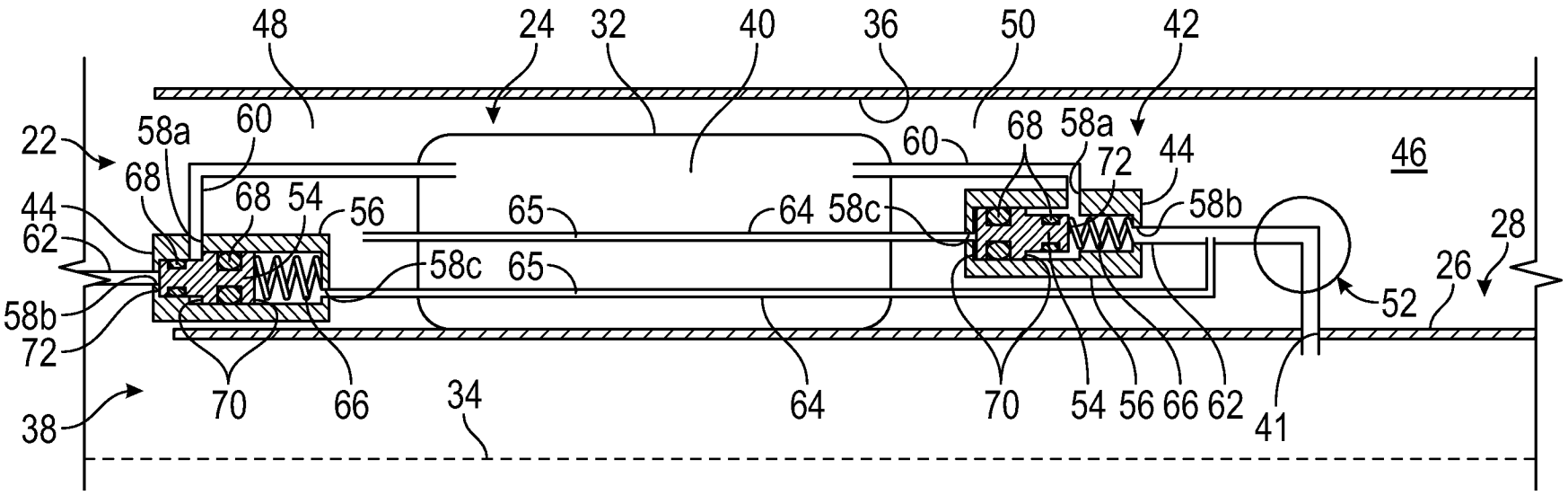
FIG. 2 is a schematic illustration of an example of an expandable metal packer positioned along a tubing, according to an embodiment of the disclosure.

Referring generally to FIG. 2, an embodiment of the expandable metal packer 24 is illustrated. In this example, the metal sealing element 32 is illustrated in a radially contracted position prior to setting of expandable metal packer 24. This radially contracted position may be used as a run-in-hole position which allows the expandable metal packer 24 and tubing string 28 to be run downhole to a desired position along borehole 22.

In the embodiment illustrated, valve system 42 comprises at least one valve 44 on one axial side of metal sealing element 32 and at least one valve 44 on the opposite side of metal sealing element 32. It should be noted that some applications may utilize a plurality of the valves 44 located on each axial side of metal sealing element 32. By way of example, each valve 44 may be a shiftable valve having a piston 54 slidably mounted in a piston housing 56. Depending on the parameters of a given application, each piston housing 56 may comprise a plurality of ports 58 to enable fluid communication with various regions.

For example, each piston housing 56 may be ported to communicate with interior 40 of metal sealing element 32; to communicate with annulus 46 on a side of the metal sealing element 32 common with that piston housing 56; and to communicate with annulus 46 on an opposite side of the metal sealing element 32. In other words, each valve 44 may be ported to interior 40 of metal sealing element 32 and to both first annulus section 48 and second annulus section 50 of the annulus 46.

Communication between the ports 58 and the corresponding pressure regions may be accomplished via suitable flow conduits. By way of example, each valve 44 may comprise a port 58*a* coupled with an outlet fluid conduit 60 in communication with interior 40. Additionally, each valve 44 may comprise a separate port 58*b* coupled with an inlet fluid conduit 62 in communication with annulus 46 on the common side of metal sealing element 32. Each valve 44 also may comprise a port 58*c* in communication with annulus 46 on an opposite side of the metal sealing element 32 via a crossover fluid conduit 64.

According to an embodiment, the ports 58*c* and corresponding crossover fluid conduits 64 may be constructed to reduce the amount of fluid which circulates through the crossover fluid conduit 64. In this example, the amount of fluid flowing through port 58*c* of each valve 44 can be a relatively small amount sufficient for sliding of the corresponding piston 54. In a variety of packer applications, very little space is available for crossover fluid conduits 64 and therefore such conduits may be constructed from small-diameter pipes (e.g. pipes with diameters ranging from 0.05 to 0.2 inches) or other suitably small conduits. To avoid plugging of the small crossover fluid conduits 64 with dirty well fluid, the crossover fluid conduits and the corresponding valve chambers within piston housing 56 may initially be filled with a clean fluid 65, e.g. a clean oil. In some applications, the clean fluid 65 may be contained in crossover fluid conduits 64 via a suitable containment mechanism, such as an elastic membrane. The elastic membrane or other containment mechanism serves to contain the clean fluid 65 within the conduit 64 while enabling communication of annulus pressure from the opposite side of metal sealing element 32.

As illustrated, each piston 54 may be biased toward a default position by a spring 66. Each spring 66 may be positioned within piston housing 56 between a given piston surface and an interior piston housing surface. Each piston 54 also may comprise a seal or a plurality of seals 68 such as O-ring seals or other suitable seals. The appropriate seals 68 are positioned around the corresponding piston 54 for sealing and sliding engagement with an interior surface of the corresponding piston housing 56.

Additionally, each piston 54 may comprise surface areas acted on by fluid pressure. For example, each piston 54 may comprise a larger diameter portion having relatively larger surface areas 70 and a smaller diameter portion having a relatively smaller surface area 72. It should be noted the surface areas 70, 72 are effectively established by the diameters of the corresponding seals 68 disposed about the relatively smaller and larger diameter portions of the piston 54. In the example illustrated, the relatively smaller surface area 72 is exposed to pressures at inlet fluid conduit 62. The relatively larger surface areas 70 (on opposite sides of the larger diameter portion of each piston 54) are exposed to pressures at outlet fluid conduit 60 and crossover fluid conduit 64, respectively. Thus, each piston 54 has surface areas acted on by pressures from opposite sides of the metal sealing element 32.

The different surface areas 70, 72 enable actuation of one or both valves according to pressure differentials in the annulus on opposite sides of the metal sealing element, as described in greater detail below. In some embodiments, different valves 44 may have pistons 54 with different surface areas relative to the pistons 54 of other valves 44 so as to enable a desired automatic shifting of specific valves 44 when exposed to certain pressure differentials. The arrangement and configuration of valves 44 allows valve system 42 to function automatically as a differential pressure valve system.

According to an embodiment, the valve 44 on the side of metal sealing element 32 corresponding with first annulus section 48 may have spring 66 positioned to act against the relatively larger surface area 70 of piston 54, as illustrated. The valve 44 on the other side of metal sealing element 32 corresponding with second annulus section 50 may have spring 66 positioned to act against the relatively smaller surface area 72 of piston 54. The surface areas 70, 72 as well as the springs 66 are selected so the valve(s) 44 on each side of metal sealing element 32 open or close off flow through the corresponding outlet conduits 60 at predetermined pressure differentials.

In the example illustrated, the valve 44 on the side of first annulus section 48 has a spring 66 rated to open for flow through outlet conduit 60 when the pressure acting on the opposite valve 44 is greater (e.g. the spring 66 is rated to open when $P_{Valve2}>P_{Valve1}$). In this example, the valve on the side of second annulus section 50 has a spring 66 rated to close off flow through the corresponding outlet conduit 60 when the pressure acting on the opposite valve 44 equals the pressure in first annulus section 48 minus the pressure in second annulus section 50 (e.g. the spring is rated to open when $P_{Valve1}=P_{Annulus1}-P_{Annulus2}$ in the range 100-500 psi).

Figure 3:
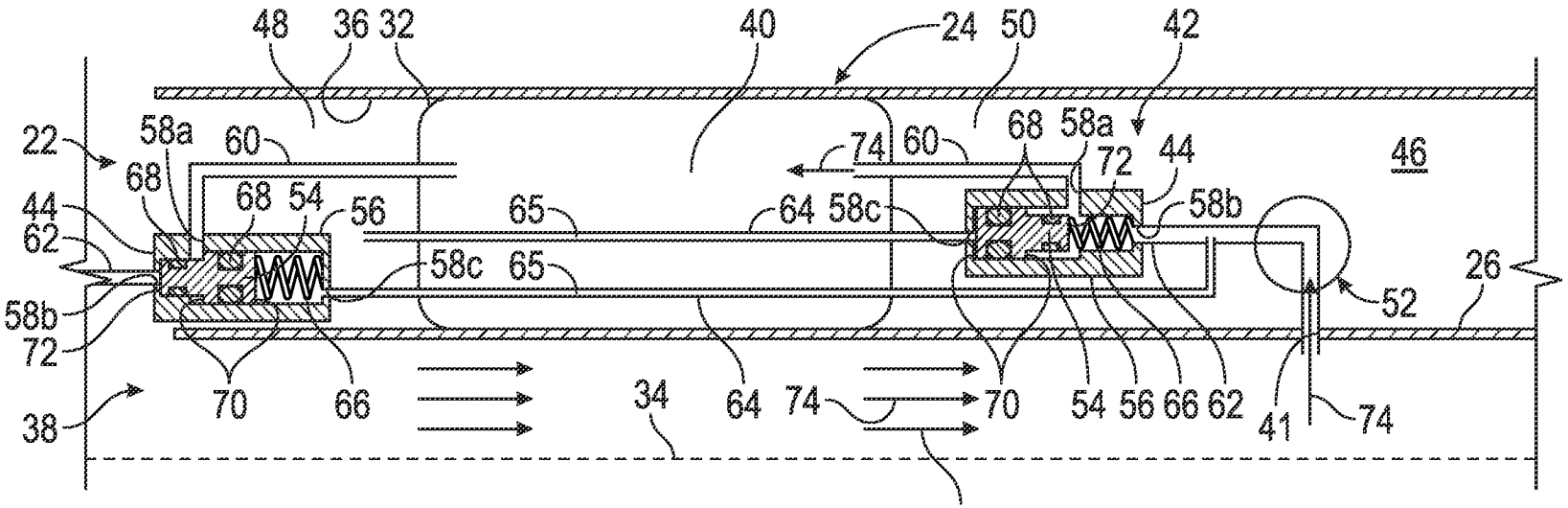
FIG. 3 is a schematic illustration similar to that of FIG. 2 but showing the expandable metal packer in a different operational position, according to an embodiment of the disclosure.

As illustrated in FIG. 3, the metal sealing element 32 may be expanded radially into sealing engagement with the surrounding wall surface 36 at a desired location along borehole 22. Once the metal sealing element 32 is sufficiently expanded, the expandable metal packer 24 is considered set and the annulus sections 48, 50 are isolated from each other along the overall annulus 46. In various embodiments, the metal sealing element 32 is plastically deformed when expanded radially to the set position.

According to the embodiment illustrated, the metal sealing element 32 is expanded radially to the set position via a pressurized fluid 74. The pressurized fluid 74 may be directed through the interior 38 of tubing 26 to passage(s) 41. At this stage, the expansion valve 52 allows the pressurized fluid 74 to travel out of tubing 26 through passage(s) 41, through the expansion valve 52, through inlet conduit 62, and into the corresponding valve 44. The corresponding spring 66 and the pressure of fluid 74 ensure the corresponding piston 54 is held in an open flow position as illustrated in FIG. 3. The open flow position allows the pressurized fluid 74 to flow through the corresponding valve 44, into outlet conduit 60, and then into interior 40 of metal sealing element 32. As the pressurized fluid 74 continues to flow into interior 40 the metal sealing element 32 is forced to expand outwardly and into sealing engagement with the surrounding wall surface 36, e.g. into a casing surface or open borehole surface.

Figure 4:
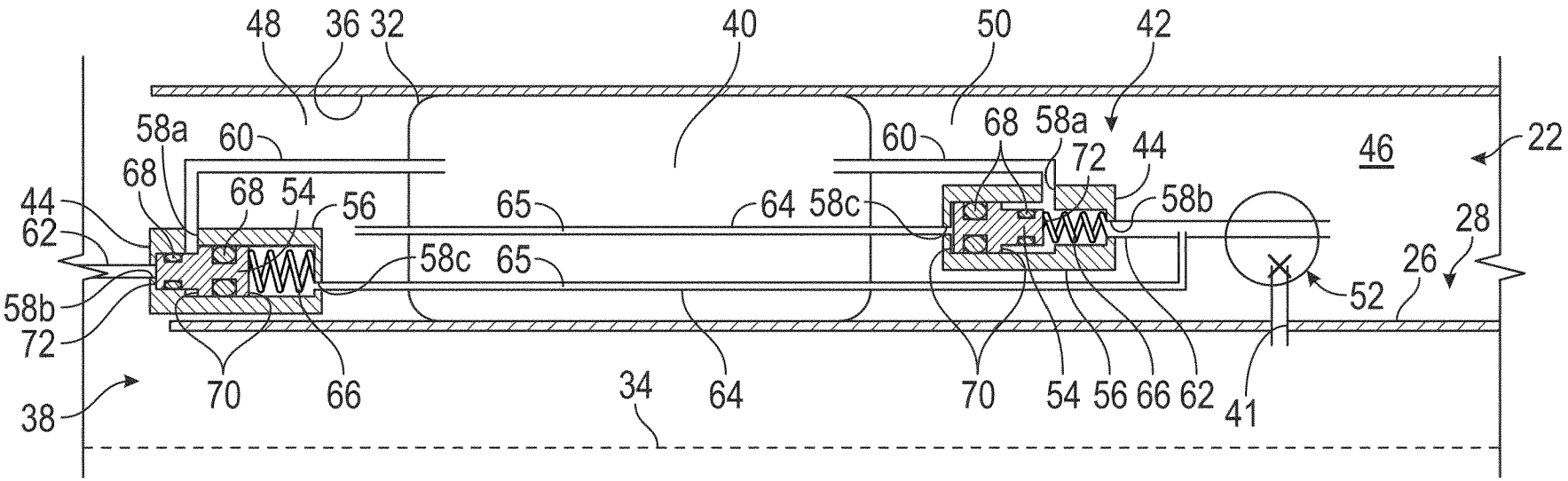
FIG. 4 is a schematic illustration similar to that of FIG. 2 but showing the expandable metal packer in a different operational position, according to an embodiment of the disclosure.

After the metal sealing element 32 is set against the surrounding wall surface 36, the expansion valve 52 is actuated to close off flow through passage(s) 41 and to open communication with the second annulus section 50 of annulus 46, as illustrated in FIG. 4. By way of example, the expansion valve 52 may be constructed to close passage 41 at a preset pressure while simultaneously opening fluid communication with second annulus section 50 of annulus 46. An example of a pressure actuated valve that may be utilized as an expansion valve is described in US patent publication 2006/042801A1. However, expansion valve 52 also may be in the form of an electrically actuated valve or other suitable valve which may be controlled to selectively block flow from the interior 38 of tubing 26 and to selectively open communication between valve system 42 and the annulus.

Differential pressures in annulus 46 automatically shift valve system 42 to different operational positions to enable the expandable metal packer 24 to hold against high differential pressures once expansion valve 52 operates to close off communication through passage(s) 41. In some embodiments, the valve system 42 also may function to enable the expandable metal packer to hold against high differential pressures without detrimental sensitivity to thermal variations acting on the packer 24.

Figure 5:
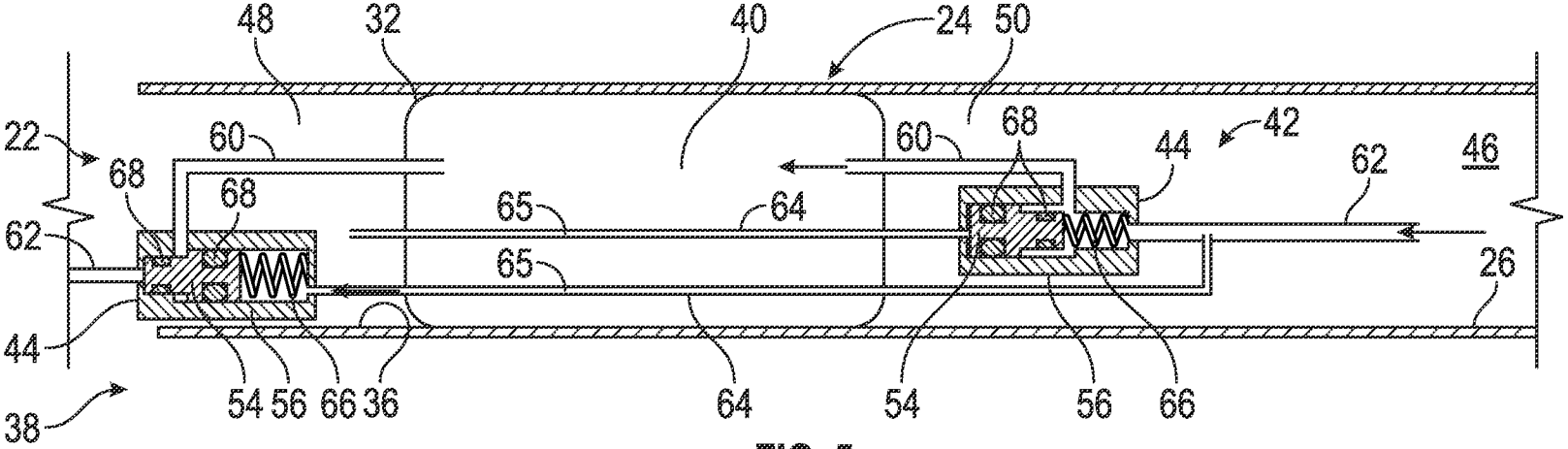
FIG. 5 is a schematic illustration similar to that of FIG. 2 but showing the expandable metal packer in a different operational position, according to an embodiment of the disclosure.

When a pressure differential occurs in annulus 46 and has a relatively higher pressure in the second annulus section 50 relative to the first annulus section 48, the valve system 42 automatically shifts to the operational position illustrated in FIG. 5. In this situation, the higher pressure in second annulus section 50 acts on the corresponding valve 44 via inlet conduit 62 and holds the piston 54/valve 44 in an open flow position. This allows the high-pressure fluid to flow through the common side valve 44, through the corresponding outlet conduit 60, and into interior 40 of metal sealing element 32. The high-pressure fluid also communicates with the valve 44 on an opposite side of the metal sealing element 32 via the corresponding crossover passageway 64 to hold the opposite valve in a closed position as illustrated. Consequently, the higher pressure acting in second annulus section 50 is directed to interior 40 to help ensure the metal sealing element 32 remains sealed against the surrounding wall surface 36 while experiencing the pressure differential. (It should be noted expansion valve 52 and the corresponding passage 41 have not been shown in FIGS. 5-7.)

Figure 6:
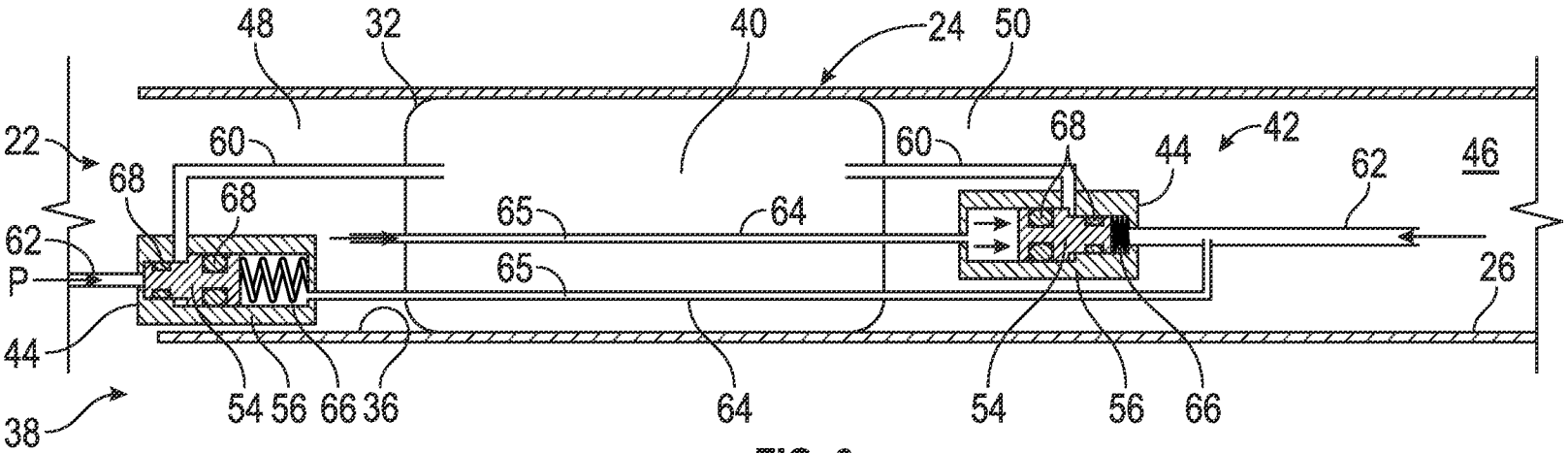
FIG. 6 is a schematic illustration similar to that of FIG. 2 but showing the expandable metal packer in a different operational position, according to an embodiment of the disclosure.

It should be noted that if the pressure differential is within a predetermined range, the valve system 42 may tend to maintain the valves 44 in a closed position on both axial sides of metal sealing element 32, as illustrated in FIG. 6. The springs 66 and the piston surface areas 70, 72 may cause the pistons 54 on both sides of metal sealing element 32 to remain in the closed position over a certain range of differential pressures.

For the purpose of providing an example, if the pressure P in first annulus section 48 is within a predetermined range relative to the pressure in second annulus section 50, this pressure P is insufficient to move the piston 54 of the common side valve 44 against the force of the corresponding spring 66. This same pressure P is able to act against the larger surface area 70 of the piston 54 in the valve 44 on an opposite side of the metal sealing element 32 via the corresponding crossover conduit 64. The biasing force of the spring 66 in the opposite side valve 44 is overcome and the corresponding piston 54 is shifted to a closed flow position, as illustrated on the right side of FIG. 6.

However, the valve system 42 may be constructed as illustrated to maintain specific valves 44 in desired closed or open positions and this ability can be used to render the valve system 42 and expandable metal packer 24 insensitive to thermal variations. For temperature insensitivity, for example, the diameters established by seals 68 may be varied slightly to create "instability". The instability is useful to reduce the potential for the piston 54 to become stuck in an undesirable position, e.g. between two ports 58. For example, the diameters may be selected so the position of pistons 54 illustrated in FIG. 6 is possible for one scenario of annulus pressures and packer internal pressure (pressure in interior 40). Consequently, a variation in the packer internal pressure causes at least one of the pistons 54 to slide in a desired direction. The variation in pressure within interior 40 may be due to thermal effects such as a build-up of pressure due to a thermal cycle. The change in packer internal pressure due to such thermal effects may thus be used to automatically shift the desired piston or pistons 54 so as to limit the sensitivity of the system to those thermal variations.

Figure 7:
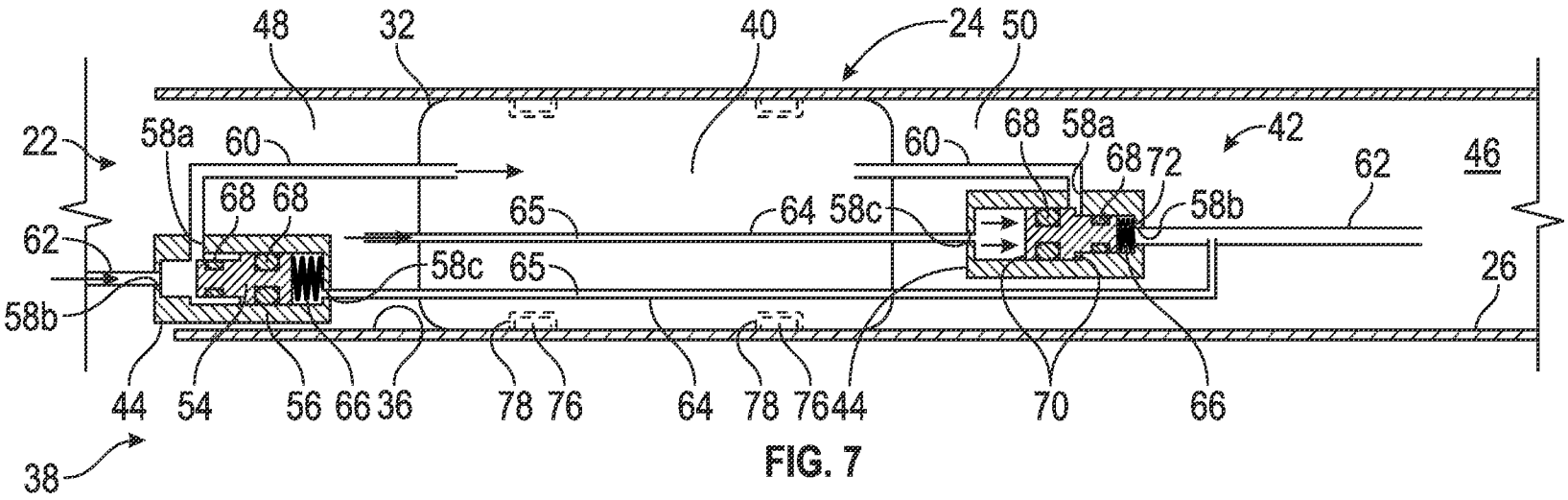
FIG. 7 is a schematic illustration similar to that of FIG. 2 but showing the expandable metal packer in a different operational position, according to an embodiment of the disclosure.

Referring generally to FIG. 7, if the pressure in first annulus section 48 becomes sufficiently greater than the pressure in second annulus section 50 this relatively high pressure in first annulus section 48 is able to automatically transition valve system 42 as illustrated. In this situation, the relatively higher pressure in first annulus section 48 is able to shift the piston 54 of the common side valve 44 against the bias of the corresponding spring 66 as illustrated on the left side of FIG. 7. The higher pressure fluid in first annulus section 48 is thus able to flow through the common side valve 44, through the corresponding outlet conduit 60, and into interior 40 of metal sealing element 32.

The relatively higher pressure fluid also communicates with the valve 44 on an opposite side of the metal sealing element 32 via the corresponding crossover passageway 64. The pressure communicated through crossover passageway 64 is sufficient to hold the opposite valve 44 in a closed position as illustrated on the right side of FIG. 7. Consequently, the higher pressure acting in first annulus section 48 is directed to interior 40 to help ensure the metal sealing element 32 remains sealed against the surrounding wall surface 36 while experiencing the pressure differential. Effectively, the valve system 42 may be used for automatically changing pressure within the metal sealing element 32 via the differential pressure valve system 42 according to the level of the pressure differential and according to the direction of the pressure differential (higher pressure in annulus section 48 or in annulus section 50).

In some embodiments, the expandable metal sealing element 32 may be combined with additional sealing elements 76 such as those illustrated via dashed lines in FIG. 7. By way of example, the expandable metal sealing element 32 may comprise an expandable metal bladder combined with a plurality of additional sealing elements 76. The additional sealing elements 76 may be formed from an elastomeric material or other suitable material to facilitate sealing engagement with the surrounding wall surface 36, e.g. surrounding casing surface or open wellbore surface, when the expandable metal packer 24 is set.

Examples of the additional sealing elements 76 include bonded rubber seals, sections of rubber mounted to metal sealing element 32, O-ring seals, or other suitable seals. The sealing elements/seals 76 may be mounted in corresponding grooves 78 formed in or around the metal sealing element 32. In some embodiments, the sealing elements 76 may comprise back-up rings combined with the elastomeric seals to provide better resistance with respect to extrusion.

The valve system 42 enables use of expandable metal packer 24 as an isolation device in a variety of operations and environments which may be subjected to high differential pressures. For example, the expandable metal packer 24 may be used in well applications and in other applications in which isolation between sections of a tubular structure is desired. The expandable metal packer 24 may be constructed with various types and sizes of metal sealing elements 32 depending on the parameters of a given operation. In a variety of well applications, the metal sealing element 32 may be formed from a plastically deformable metal membrane, bladder, or other metal structure which may be radially expanded via fluid pressure.

Similarly, the valve system 42 may utilize single valves 44 or plural valves 44 on each axial side of metal sealing element 32. The structure of each valve 44 may be selected according to the parameters of a given use and/or environment. For example, the valves 44 may comprise various types of pistons, seals, springs, piston housings, and/or other components. The relative surface areas provided by the piston/seals may be selected according to the anticipated pressures and the desired operation of the overall valve system 42. The overall tubing string 28 also may utilize many types of components and have various configurations suited for the operation and environment in which it is utilized.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing;

an expandable metal packer mounted along the tubing, the expandable metal packer having a metal sealing element which may be expanded radially outwardly into sealing engagement with a surrounding wall surface;

an expansion valve positioned to control flow of a pressurized fluid from an interior of the tubing to an interior of the metal sealing element to enable expansion of the metal sealing element into the sealing engagement with the surrounding wall surface; and a differential pressure valve system comprising a plurality of shiftable valves which automatically respond to pressure differentials occurring between opposite axial sides of the metal sealing element in an annulus between the tubing and the surrounding wall surface, the plurality of shiftable valves automatically shifting to allow the relatively higher pressure of the pressure differential access to the interior of the metal sealing element to enable the metal sealing element to hold against the differential pressure.

2. The system as recited in claim 1, wherein the expansion valve is shiftable to block communication between the interior of the tubing and the interior of the metal sealing element.

3. The system as recited in claim 2, wherein the expansion valve opens communication with the annulus upon blocking communication between the interior of the tubing and the interior of the metal sealing element.

4. The system as recited in claim 1, wherein the a plurality of shiftable valves comprises a first shiftable valve located in the annulus on a first axial side of the metal sealing element and a second shiftable valve located in the annulus on a second axial side of the metal sealing element.

5. The system as recited in claim 4, wherein each shiftable valve comprises a piston slidably mounted in a piston housing and biased toward a default position via a spring.

6. The system as recited in claim 5, wherein the piston housing of each shiftable valve is ported to the interior of the metal seal element; to the annulus on a side of the metal sealing element common with the piston housing; and to the annulus on an opposite side of the metal sealing element via a crossover fluid conduit filled with a clean fluid.

7. The system as recited in claim 6, wherein the first shiftable valve automatically shifts to a closed position blocking flow into the metal sealing element and the second shiftable valve automatically shifts to an open position allowing flow into the metal sealing element upon the occurrence of a pressure differential with a sufficiently higher pressure in the annulus on the side of the second valve compared to the pressure in the annulus on an opposite side of the metal sealing element.

8. The system as recited in claim 7, wherein the second shiftable valve automatically shifts to a closed position blocking flow into the metal sealing element and the first shiftable valve automatically shifts to an open position allowing flow into the metal sealing element upon the occurrence of a pressure differential with a sufficiently higher pressure in the annulus on the side of the first valve compared to the pressure in the annulus on an opposite side of the metal sealing element.

9. The system as recited in claim 8, wherein the first shiftable valve and the second shiftable valve are both shifted to a closed position during a predetermined differential pressure range with respect to pressures in the annulus on opposite sides of the metal sealing element.

10. A system, comprising: an expandable metal packer having a metal sealing element which is radially expandable by fluid entering an interior of the metal sealing element under pressure; and a valve system in communication with the metal sealing element to enable an increase in pressure in the interior of the metal sealing element when sufficient pressure differentials act on the metal sealing element after radial expansion of the metal sealing element, the valve system comprising a pair of valves, each valve being in fluid communication with the interior of the metal sealing element and with annulus regions on both sides of the metal sealing element.

11. The system as recited in claim 10, further comprising a tubing, the metal sealing element being positioned around the tubing.

12. The system as recited in claim 11, further comprising an expansion valve positioned to control flow of a pressurized fluid from an interior of the tubing to the interior of the metal sealing element to enable expansion of the metal sealing element into sealing engagement with a surrounding wall surface.

13. The system as recited in claim 11, wherein the pair of valves comprises valves positioned on opposite axial sides of the metal sealing element.

14. The system as recited in claim 11, wherein the metal sealing element is constructed to permanently deform into sealing engagement with a surrounding wall surface when radially expanded, the metal sealing element being combined with additional sealing elements to ensure isolation of sections of an annulus between the tubing and the surrounding wall surface.

15. The system as recited in claim 14, wherein each valve of the pair of valves comprises a piston slidably mounted in a piston housing.

16. The system as recited in claim 15, wherein each piston has surface areas acted on by pressures from opposite sides of the metal sealing element, the surface areas having different sizes selected to enable actuation of one or both valves according to the pressure differential in the annulus between opposite sides of the metal sealing element.

17. A method, comprising:

providing a packer with a tubing, a metal sealing element mounted around the tubing, and a differential pressure valve system;

moving the packer downhole into a borehole;

setting the packer by expanding the metal sealing element via a fluid under pressure until the metal sealing element seals against a surrounding wall surface, and delivering the fluid under pressure through an interior of the tubing;

automatically changing pressure within the metal sealing element via the differential pressure valve system according to a direction and level of a pressure differential occurring in an annulus between the tubing and the surrounding wall surface;

using the differential pressure valve system to automatically compensate for thermal effects acting on the packer; and using an expansion valve to control flow of the fluid under pressure from the interior of the tubing to an interior of the metal sealing element;

wherein providing comprises providing the differential pressure valve system with a plurality of shiftable valves comprising a first shiftable valve located in the annulus on a first axial side of the metal sealing element and a second shiftable valve located in the annulus on a second axial side of the metal sealing element, each shiftable valve comprising a piston slidably mounted in a piston housing and biased toward a default position via a spring, each piston housing being ported to: the interior of the metal sealing element; the annulus on a side of the metal sealing element common with the piston housing; and the annulus on an opposite side of the metal sealing element via a crossover fluid conduit initially filled with a clean fluid.

* * * * *